US005127944A

United States Patent [19]

Yamate

[11] Patent Number: 5,127,944

[45] Date of Patent: Jul. 7, 1992

[54] METHOD FOR PRODUCING DESIGNS AND IMAGE PATTERNS ON DENIM PRODUCTS, AND PASTE AGENTS FOR DRAWING DESIGNS ON DENIM PRODUCTS

[76] Inventor: Masato Yamate, 612-2, Managura, Ekiya-cho, Fukuyama-shi, Hiroshima-ken, Japan

[21] Appl. No.: 606,069

[22] Filed: Oct. 30, 1990

Related U.S. Application Data

[63] Continuation of Ser. No. 559,538, Jul. 23, 1990, abandoned, which is a continuation of Ser. No. 257,669, Oct. 14, 1988, abandoned.

[30] Foreign Application Priority Data

Jan. 8, 1988 [JP] Japan ..... 63-2702
Jul. 13, 1988 [JP] Japan ..... 63-175578

[51] Int. Cl.[5] ..... C09K 15/18
[52] U.S. Cl. ..... 106/2; 106/157
[58] Field of Search ..... 106/2, 157, 415, 154.1

[56] References Cited

U.S. PATENT DOCUMENTS

| | | | |
|---|---|---|---|
| 551,530 | 12/1895 | Doebrich | 106/157 |
| 2,089,063 | 8/1937 | Johnson | 106/157 |
| 2,185,181 | 1/1940 | Bronsztajn | 106/157 |
| 2,369,766 | 2/1945 | Witty | 106/157 |
| 2,453,752 | 11/1948 | La Piara et al. | 106/157 |
| 3,371,061 | 2/1968 | Pickett | 106/415 |
| 3,515,588 | 6/1970 | Sadler | 106/157 |

FOREIGN PATENT DOCUMENTS

| | | | |
|---|---|---|---|
| 5697 | of 1908 | United Kingdom | 106/157 |

*Primary Examiner*—Theodore Morris
*Assistant Examiner*—David M. Brunsman
*Attorney, Agent, or Firm*—McAulay Fisher Nissen Goldberg & Kiel

[57] ABSTRACT

A bleach inhibiting agent in paste form comprising 0.375 parts by weight deutoplasm; 0.25 parts by weight albumen; 0.125 parts by weight granulated egg shell; 0.25 parts by weight wheat flour; and 0.05–0.15 parts by weight of industrial alcohol based on the combined weight of the deutoplasm, albumen, granulated egg shell, and wheat flour.

1 Claim, 1 Drawing Sheet

METHOD FOR PRODUCING DESIGNS AND IMAGE PATTERNS ON DENIM PRODUCTS, AND PASTE AGENTS FOR DRAWING DESIGNS ON DENIM PRODUCTS

This is a continuation of application Ser. No. 559,538, filed Jul. 23, 1990 now abandoned, which, in turn, is a division of application Ser. No. 257,669, filed Oct. 14, 1988, now abandoned.

SUMMARY OF THE INVENTION

This invention relates to a method for producing design patterns on denim products including sewed products and/or cloth materials such as pants, trousers, and jackets and pastes to be used for producing design patterns. This method features that any desired design patterns are painted at any prompt positions of denim products including denim materials and sewed products such as pants, trousers and jackets together with wax or paste material which has been produced by mixing and agitating the white of eggs (hereinafter merely called "albumen") and the yellow of eggs (hereinafter merely called "deutoplasm" or granulated shells of eggs (hereinafter merely called "shells") with paste, these denim products and/or denim materials are put into drum cage, and at the same time pumice stones (hereinafter merely called "pumices") which have been immersed and seasoned in hypochlorous acid calcium water are put into the same drum cage, and these denim products and denim materials are rotated together with pumices in said drum cage as said drum cage rotates. At this time, design patterns painted or drawn on said denim products and denim materials can remain dark blue (or deep blue) by aid of mutual rubbing and/or friction between said denim products or materials and said pumices in comparison with the other unpainted or drawn parts of denim products and denim materials. Said method further features in other words that deutoplasm and albumen or granulated shells are mixed and agitated in industrial alcohol together with wheat flour and water-soluble paint at the ratio of 5 to 20% in the weight percentage of said deutoplasm and albumen or granulated or powdered shells, thereby causing a paste agent having a prompt hardness to be produced, said paste agent is used for painting or drawing any desired designs at any prompt position of denim products including denim sewed products or denim cloth materials, and said paste agent is dried promptly and further is dried after giving a coat of a glaze whose main constituent is albumen, said denim products and denim cloth materials are put into a water solution in which hypochlorous acid calcium is contained at the ratio of 5 to 15% in the weight percentage of said water solution, and said denim products and denim cloth materials are agitated for a specified period of time, thereby causing said design patterns to remain dark blue (or deep blue).

BACKGROUND OF THE INVENTION

Today, denim products have been much popular, as pants, trousers and/or jackets. These denim products are made of thick cotton fabrics whose warps are dark blue and whose wefts are white and which are of diagonal weave or plain weave. There are generally two methods for producing design patterns on these denim products, one of which is a chemical washing method in which said denim products are put into a drum cage and a specified quantity of pumice which has been immersed and seasoned in hypochlorous acid calcium water is put in said drum cage altogether and marble-like spotted design patterns can be produced by aid of rubbing and friction between said denim woven products and said pumice by rotating said denim woven products together said pumice in said rotary drum cage, and the other of which is called a chemical bleaching method in which said denim woven products are agitated for a specified period of time in water solution whose hypochlorous acid calcium density is about 6%, thereby causing said denim woven products to be totally white-bleached.

OBJECTS OF THE PRESENT INVENTION

In the former chemical washing method, the design is produced by only a number of irregular spots, and in the latter chemical bleaching method said denim woven products are only totally white-bleached. Namely in either case, produced design is merely vague. Therefore, these two conventional methods do not meet any requirements of recent youngsters who want that design pattern is novel, bold and individual and do not give us any designs of free drawing or painting.

Main object of the present invention is to provide a method by which not only simple marble-like spotted designs and another design that said denim woven products are only totally white-bleached but also bold, novel and individual designs can be freely produced in a simple manner.

DESCRIPTION OF THE PREFERRED EMBODIMENT

[Example (1) of embodiments]

A paste agent is produced by mixing and agitating albumen and wheat flour paste at the ratio of 1 to 0.5, any desired design is drawn by using this paste agent by a paint brush on any part of any denim woven product (eg. sewed jacket, pants, trousers and denim woven materials). Then, about twenty sets of pants, jackets or trousers are put in a drum cage and a specified quantity (about 40 Kilograms) of pumice that has been immersed and seasoned in hypochlorous acid calcium water is put in said drum cage. And said drum cage is rotated clockwise and counterclockwise (eg. at a speed of 30 r.p.m.) for fifteen minutes. Under this condition, all the other part than the design parts drawn and painted with said paste agent by a paint brush is spotted like marble, but the mark "m" drawn and painted with said paste agent can remain dark blue. A product (jacket) shown in FIG. 1 can be obtained.

[Example (2) of embodiments]

Figure 1:
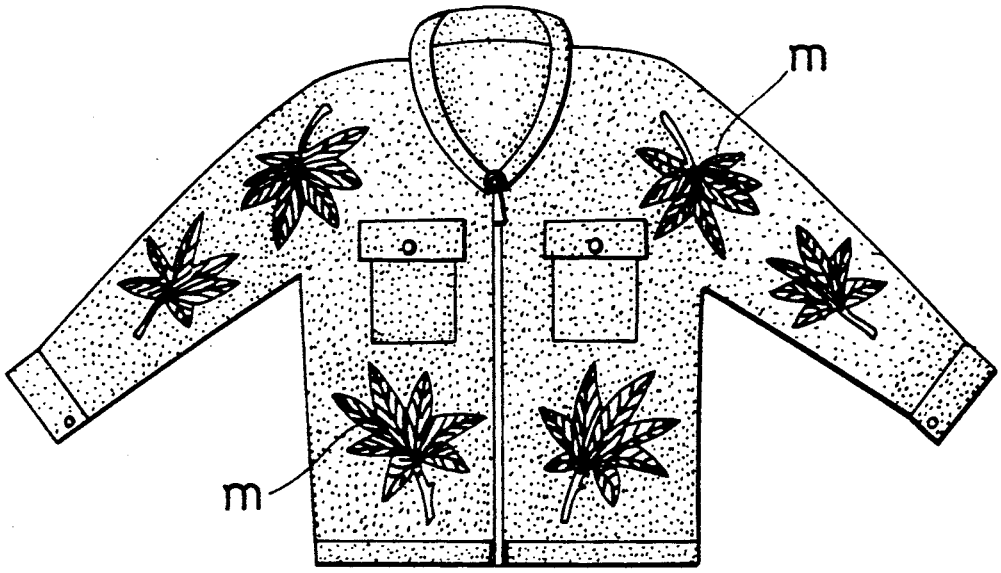
FIG. 1 is an front elevational view showing a denim woven product (a jacket) produced by a method disclosed by the present invention.

Another paste agent is produced by agitating and mixing deutoplasm (0.375), albumen (0.25), powderily granulated shells (0.125) and wheat flour paste (0.25) at the ratio shown in the above brackets. Using this paste agent, any free and prompt design is drawn and painted on said denim woven product (eg. a sewed jacket) by a paint brush. About twenty jackets are put in said drum cage and are rotated in the same manner as that shown in the [example (1)]. Then, denim woven products shown in FIG. 1 can be obtained, on which the part drawn and painted with said paste agent can remain clearly dark blue as shown in FIG. 1.

[Example (3) of embodiments]

Still another paste agent is produced agitating and mixing albumen and powderily granulated shells together with wheat flour and water soluble paint (Blue) at the ratio of 9% in the weight percentage of said albumen and shells in industrial alcohol. Using this paste agent, any desired design "m" is drawn and painted on a denim woven material by a paint brush and said denim woven material is dried in a drying chamber for a specified period of time. After that, said denim woven material is taken out from said drying chamber and is further furnished with a glaze (100% albumen) on said design. Then, said denim woven material is dried again.

Next, said dried denim woven material is put in 6% hypochlorous acid calcium water solution and is agitated in it for about seven minutes. Finally, said denim woven material is take out from said water solution. The whole surface of said denim woven material is white-bleached but said design "m" can remain clearly dark blue. Namely, a product shown in FIG. 1 can be obtained.

[Example (4) of embodiments]

Further another paste agent is produced by agitating and mixing deutoplasm and powderily granulated shells with a prompt quantity of wheat flour in industrial alcohol in order to get a prompt hardness, adding water-soluble paint (Green) at the ratio of 10% of the total weight and agitating and mixing altogether. Any desired design is drawn with this paste agent on any prompt part of a jacket made of denim woven material period of time in a drying chamber. Then, said jacket is taken out, is furnished with a glaze whose contents is albumen by 95% and gelatine by 5% and is dried again.

Figure 2:
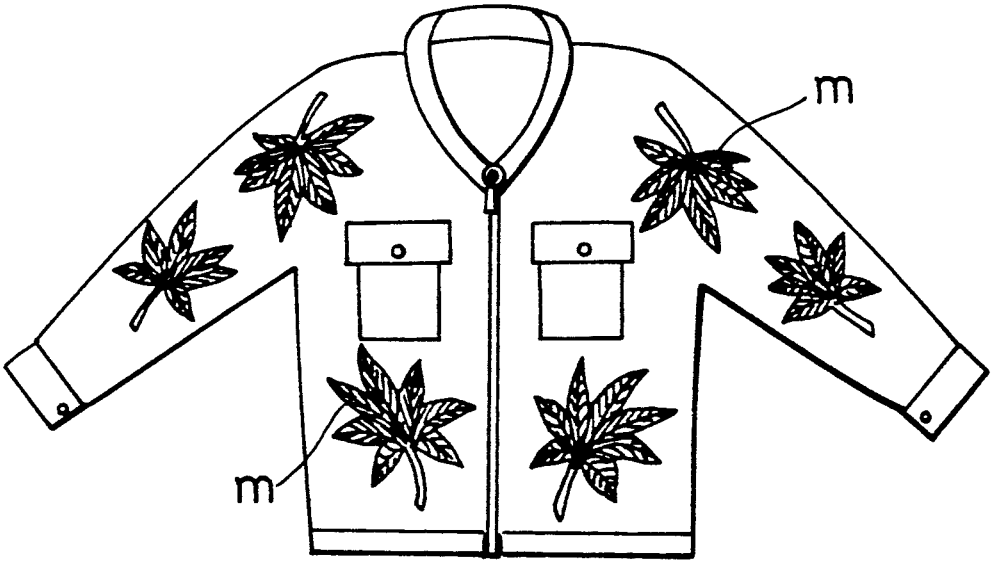
FIG. 2 is another front elevational view showing a denim woven products (also a jacket) produced by another method disclosed by the present invention.

Said jacket is put in a water solution containing a hypochlorous acid calcium by 7% of the total weight thereof and is agitated in said water/hypochlorous acid calcium solution for about ten minutes. In this case, the whole surface of said denim woven materials is white-bleached but said design "m" can remain clearly dark blue. Namely, a product shown in FIG. 2 can be obtained.

As described in the above four examples of embodiments, the method disclosed by the present invention can provide design denim products and materials which can best suit to the requirements and needs of recent youngsters, at a low cost, by drawing various kinds of novel, bold and individual designs on said denim products and materials including jackets, pants and other denim cloth materials in a simple manner.

Use of paste agents in the present invention is very convenient to provide variations of design, and such paste agents can be cheaply produced in a simple manner by agitating and mixing eggs with paste and/or together with powderily granulated shells of eggs at a prompt ratio. By changing the mixing ratio thereof, paste agents of different hardness can be obtained, and novel and/or varied color design and/or patterns can be freely reproduced uniformly on denim products by selectively using said paste agents of different hardness and controlling the adhering amount thereof onto said denim products.

I claim:

1. A bleach inhibiting agent in paste form comprising:

0.375 parts by weight deutoplasm;

0.25 parts by weight albumen;

0.125 parts by weight granulated egg shell;

0.25 parts by weight whet flour; and 0.05–0.15 parts by weight of industrial alcohol based on the combined weight of the deutoplasm, albumen, granulated egg shell, and wheat flour.

* * * * *